US007172485B2

(12) United States Patent
Thai

(10) Patent No.: US 7,172,485 B2
(45) **Date of Patent: *Feb. 6, 2007**

(54) BUBBLE GENERATING ASSEMBLY

(75) Inventor: Douglas Thai, Walnut, CA (US)

(73) Assignee: Arko Development Ltd., Hong Kong (HK)

( * ) Notice: Subject to any disclaimer, the term of this patent is extended or adjusted under 35 U.S.C. 154(b) by 7 days.

This patent is subject to a terminal disclaimer.

(21) Appl. No.: 11/083,719

(22) Filed: Mar. 18, 2005

(65) Prior Publication Data

US 2005/0164593 A1 Jul. 28, 2005

Related U.S. Application Data

(63) Continuation of application No. 10/872,715, filed on Jun. 21, 2004, now Pat. No. 6,921,312, which is a continuation of application No. 10/448,660, filed on May 30, 2003, now Pat. No. 6,755,710, which is a continuation of application No. 10/163,026, filed on Jun. 5, 2002, now Pat. No. 6,572,427.

(51) Int. Cl.
*A63H 33/28* (2006.01)
*A63H 33/40* (2006.01)

(52) U.S. Cl. ..... 446/15; 446/176

(58) Field of Classification Search ..... 446/15, 446/16, 18, 21, 176, 178, 179, 180, 483
See application file for complete search history.

(56) References Cited

U.S. PATENT DOCUMENTS

| | | | | |
|---|---|---|---|---|
| 4,423,565 | A | 1/1984 | Bart | |
| 5,462,469 | A | 10/1995 | Lei | |
| 5,498,191 | A | 3/1996 | DeMars | |
| 5,520,564 | A | 5/1996 | DeMars | |
| 5,613,890 | A | 3/1997 | DeMars | |
| 5,975,358 | A | 11/1999 | Zheng | |
| 6,416,377 | B1 | 7/2002 | Bart | |
| 6,572,427 | B1 | 6/2003 | Thai | |
| 6,616,498 | B1 | 9/2003 | Thai | |
| 6,969,293 | B2 * | 11/2005 | Thai | 446/15 |
| 2004/0176011 | A1 * | 9/2004 | Thai | 446/15 |

* cited by examiner

*Primary Examiner*—Nini F. Legesse
(74) *Attorney, Agent, or Firm*—Raymond Sun

(57) ABSTRACT

A bubble generating assembly has a housing, a container coupled to the housing and retaining bubble solution, a trigger mechanism, a bubble generating device, a tubing that couples the interior of the container with the bubble generating device, a stationary wiping bar that is fixed to the housing, and a link assembly housed inside the housing. The link assembly couples the trigger mechanism and the bubble generating device in a manner in which actuation of the trigger mechanism causes the bubble generating device to move past the wiping bar and to contact the wiping bar, so as to create a film of bubble solution across the bubble generating device.

19 Claims, 12 Drawing Sheets

BUBBLE GENERATING ASSEMBLY

This application is a continuation of Ser. No. 10/872,715 filed Jun. 21, 2004 (U.S. Pat. No. 6,921,312), which is a continuation of Ser. No. 10/448,660 filed May 30, 2003 (U.S. Pat. No. 6,755,710), which is a continuation of Ser. No. 10/163,026 filed Jun. 5, 2002 (U.S. Pat. No. 6,572,427).

BACKGROUND OF THE INVENTION

1. Field of the Invention

The present invention relates to bubble toys, and in particular, to a bubble generating assembly which automatically forms a bubble film over a bubble ring without the need to dip the bubble ring into a container or a dish of bubble solution.

2. Description of the Prior Art

Bubble producing toys are very popular among children who enjoy producing bubbles of different shapes and sizes. Many bubble producing toys have previously been provided. Perhaps the simplest example has a stick with a circular opening or ring at one end, resembling a wand. A bubble solution film is produced when the ring is dipped into a dish that holds bubble solution or bubble producing fluid (such as soap) and then removed therefrom. Bubbles are then formed by blowing carefully against the film. Such a toy requires dipping every time a bubble is to created, and the bubble solution must accompany the wand from one location to another.

Recently, the market has provided a number of different bubble generating assemblies that are capable of producing a plurality of bubbles. Examples of such assemblies are illustrated in U.S. Pat. Nos. 6,149,486 (Thai), 6,331,130 (Thai) and 6,200,184 (Rich et al.). The bubble rings in the bubble generating assemblies in U.S. Pat. Nos. 6,149,486 (Thai), 6,331,130 (Thai) and 6,200,184 (Rich et al.) need to be dipped into a dish that holds bubble solution to produce films of bubble solution across the rings. The motors in these assemblies are then actuated to generate air against the films to produce bubbles.

All of these aforementioned bubble generating assemblies require that one or more bubble rings be dipped into a dish of bubble solution. In particular, the child must initially pour bubble solution into the dish, then replenish the solution in the dish as the solution is being used up. After play has been completed, the child must then pour the remaining solution from the dish back into the original bubble solution container. Unfortunately, this continuous pouring and re-pouring of bubble solution from the bottle to the dish, and from the dish back to the bottle, often results in unintended spillage, which can be messy, dirty, and a waste of bubble solution.

Another bubble generating assembly is illustrated in U.S. Pat. No. 5,613,890 (DeMars). DeMars uses a battery-operated machine to control a wiper bar to apply bubble solution onto a stationary bubble ring to form the film of bubble solution across the face of the bubble ring. Although such a design avoids some of the spillage problems described above, the construction of the bubble generating assembly in DeMars is quite complex, which increases the overall cost of the bubble generating assembly. More importantly, the complex construction has many different moving and interengaging parts that increase the likelihood of defects. Sadly, any defect with any part could mean that the entire assembly is not operational. In addition, DeMars uses a single motor which powers two operations: (1) to pump the bubble solution to the wiper bar, and (2) to cause the fan to blow air at the bubble ring. Depending on the size and quality of the motor, the single motor may not be able to simultaneously perform both tasks effectively, which may negatively affect the quality of the bubbles produced by the bubble generating assembly.

Thus, there remains a need to provide an apparatus and method for forming a film of bubble solution,across a bubble ring while avoiding the problems described above.

SUMMARY OF THE DISCLOSURE

It is an object of the present invention to provide an apparatus and method for effectively forming a film of bubble solution across a bubble ring.

It is another object of the present invention to provide an apparatus and method for effectively forming a film of bubble solution across a bubble ring in a manner which minimizes spillage of the bubble solution.

It is yet another object of the present invention to provide an apparatus having a simple construction that effectively forms a film of bubble solution across a bubble ring.

The objectives of the present invention are accomplished by providing a bubble generating assembly having a housing, a container coupled to the housing and retaining bubble solution, a trigger mechanism, a bubble generating device, a tubing that couples the interior of the container with the bubble generating device, a stationary wiping bar that is fixed to the housing, and a link assembly housed inside the housing that couples the trigger mechanism and the bubble generating device in a manner in which actuation of the trigger mechanism causes the bubble generating device to move past the wiping bar and to contact the wiping bar, so as to create a film of bubble solution across the bubble generating device.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims. In certain instances, detailed descriptions of well-known devices and mechanisms are omitted so as to not obscure the description of the present invention with unnecessary detail.

Figure 1:
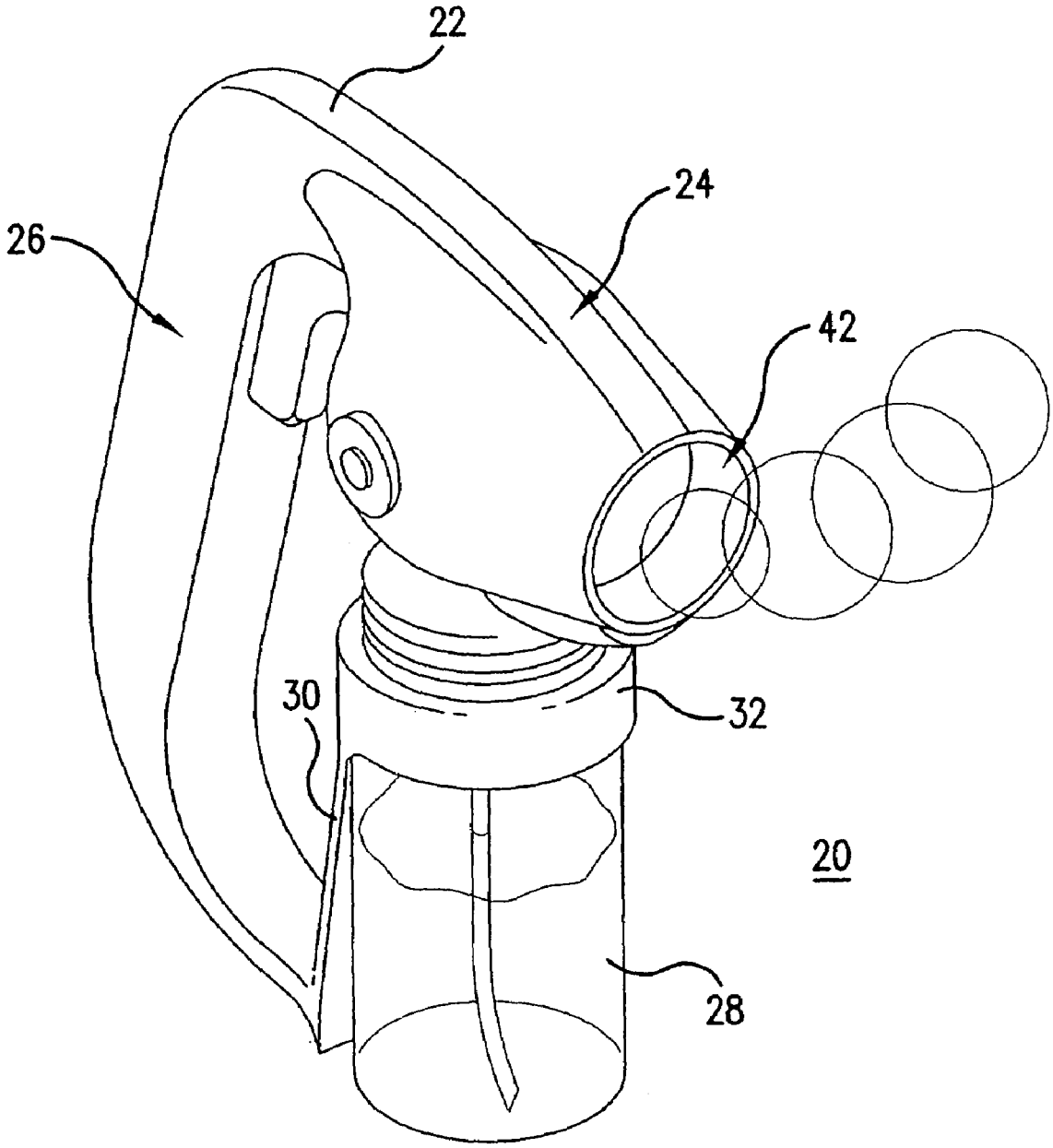
FIG. 1 is a perspective view of a bubble generating assembly according to one embodiment of the present invention.
Figure 2:
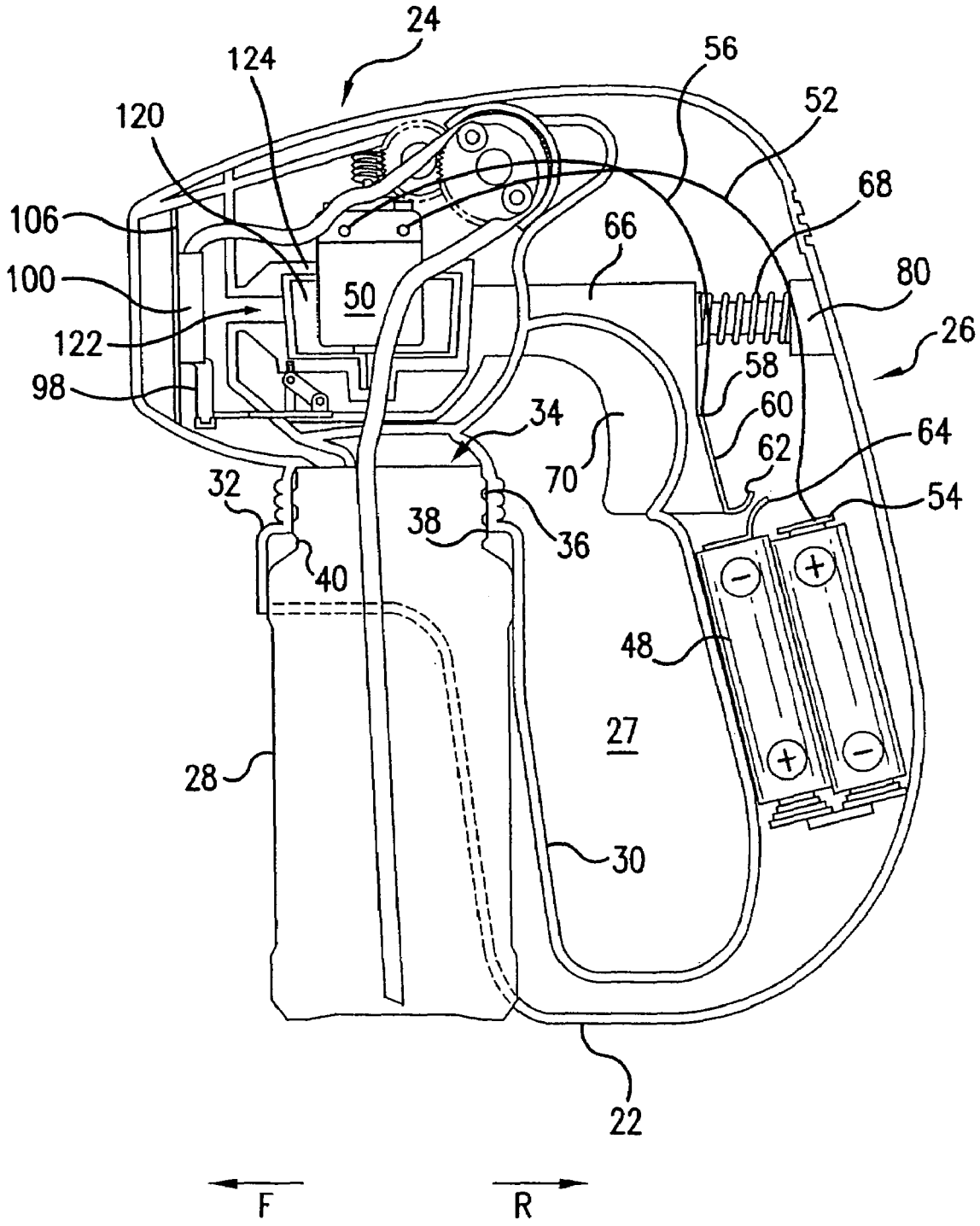
FIG. 2 is a cross-sectional view of the assembly of FIG. 1 shown with the bubble ring in its normal rest position.
Figure 3:
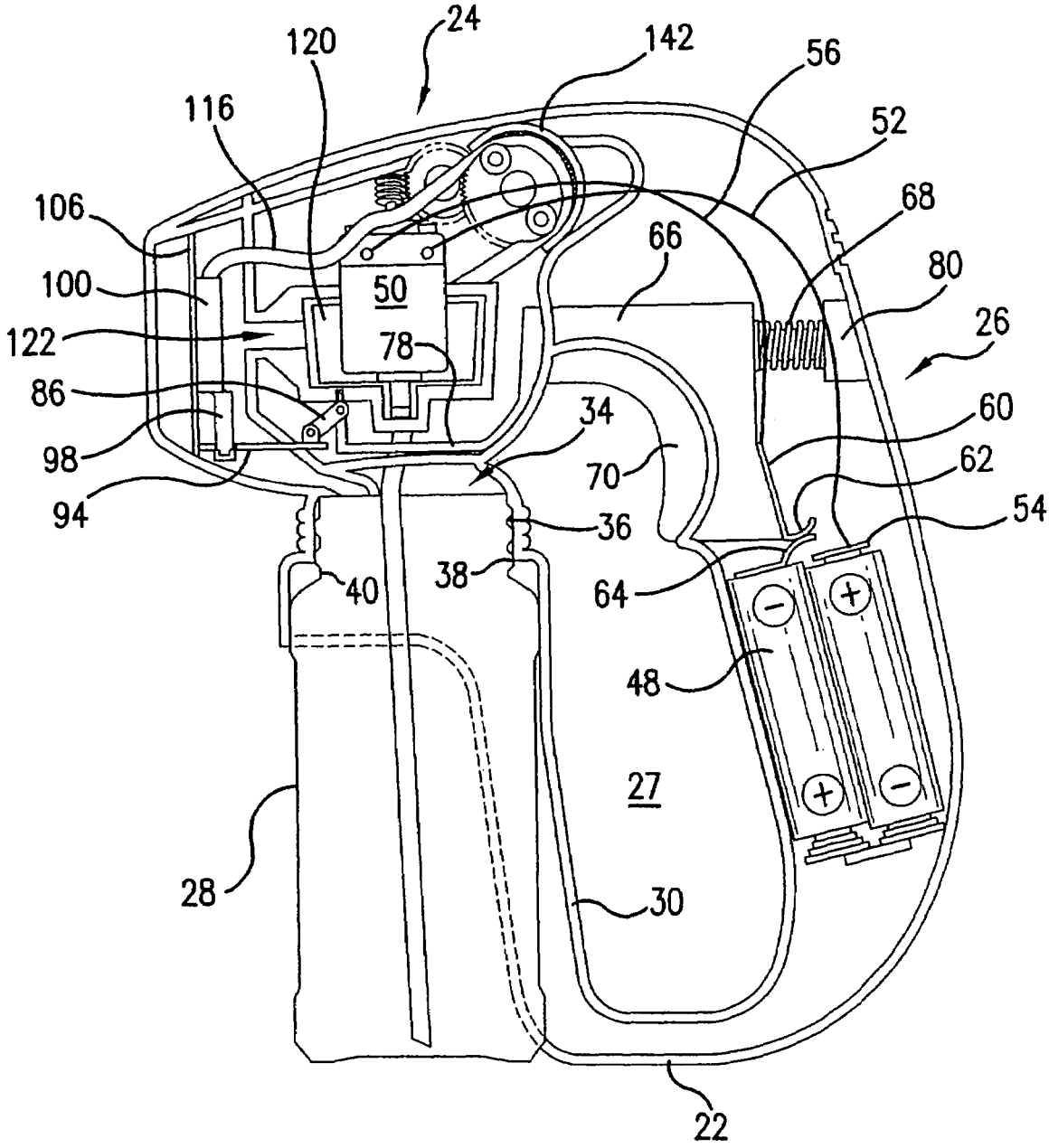
FIG. 3 is a cross-sectional view of the assembly of FIG. 1 shown with the bubble ring positioned after the bubble ring has moved passed the wiping bar.

FIGS. 1–3 illustrate one embodiment of a bubble generating assembly 20 according to the present invention. The assembly 20 has a housing 22 that includes a handle section 26 and a barrel section 24. The housing 22 can be provided in the form of two symmetrical outer shells that are connected together by, for example, screws or welding or glue. These outer shells together define a hollow interior for housing the internal components of the assembly 20, as described below. A bubble generating device is provided inside the barrel section 24, and a bubble solution container 28 is releasably secured to a portion of the barrel section 24. The bubble solution container 28 can be provided in the form of any of the conventional bubble solution containers that are currently available in the marketplace. The housing 22 also includes a container shield 30 that extends from the bottom of the handle section 26 to a connecting portion 32 adjacent the bottom of the barrel section 24. The handle section 26 and the container shield 30 together define a trigger space 27 through which a user can extend his or her fingers to grip the handle section 26. As best shown in FIGS. 2 and 3, the connecting portion 32 of the container shield 30 has an opening 34 that opens into the hollow interior of the barrel section 24, with internal threads 36 adjacent the opening 34 to releasably engage the external threads 38 provided on the neck 40 of the container 28. An opening 42 is provided at the front of the barrel section 24.

The handle section 26 houses a power source 48 which can include at least one conventional battery. The barrel section 24 has a motor and blower housing 124 that houses a motor 50 that is electrically coupled to the power source 48 via a first wire 52 and a first electrical contact 54. A second wire 56 couples the motor 50 to a first end 58 of a second electrical contact 60, whose second curved end 62 is adapted to releasably contact a third electrical contact 64 that is coupled to the power supply 48. The second contact 60 is attached to the rear end of a trigger block 66. The trigger block 66 is normally biased in a forward direction towards the barrel section 24 by a resilient element 68 (e.g., a spring). As a result, the forward bias of the trigger block 66 means that the second contact 60 carried on the trigger block 66 is also normally biased away from the third contact 64. The resilient element 68 is supported by an elongated support block 80 that is secured to the housing 22 and which is normally spaced-apart from the rear end of the trigger block 66 by the resilient element 68. The support block 80 acts as a stop member to prevent the trigger block 66 from being pressed too far in the rearward direction, since the trigger block 66 will contact the front end of the support block 80 when the trigger block 66 is pressed to its rear-most position.

FIGS. 2, 3, 7 and 8 illustrate the link assembly that couples the trigger block 66 to the bubble generating device, which can be embodied in the form of a bubble ring 100. The trigger block 66 has a configuration that resembles a gun, or an L-shape, with a leg portion 72 that is perpendicular to a shaft portion 74. The trigger block 66 is partially retained inside the interior of the housing 22, with a trigger grip portion 70 extending through the housing 22 into the trigger space 27. The trigger grip portion 70 represents a front part of the leg portion 72. A generally U-shaped bar 78 extends from the front of the shaft portion 74. The front leg 82 of the U-shaped bar 78 has an opening through which a first hooked end 84 of an axle bar 86 extends for pivoting movement therewith. The center of the axle bar 86 has an opening through which one end of a fixed bar 88 extends. The fixed bar 88 is fixed at a location and acts as a fixed pivot about which the axle bar 86 can pivot. The second end of the axle bar 86 has another opening through which a coupling pin 90 extends. The coupling pin 90 couples the axle bar 86 to an extension 92 of a horizontal slide plate 94 for pivoting movement between the axle bar 86 and the slide plate 94. Thus, the front leg 82, the axle bar 86 and the slide plate 94 are coupled to experience pivoting movement with respect to each other when the trigger block 66 is pressed and released.

An angled slot 95 is provided adjacent an angled front edge 96 of the slide plate 94, and is positioned to receive a vertical support shaft 98 of the bubble ring 100. The support shaft 98 is adapted to experience horizontal (e.g., left and right) movement along a horizontal rail 102 that is secured to the interior of the barrel section 24 adjacent the opening 42 of the housing 22. The angled nature of the slot 95 allows for the reciprocating front-rear movement of the slide plate 94 to cause the support shaft 98 to move left and right along the rail 102 as the support shaft 98 travels within the angled slot 96.

Figure 5:
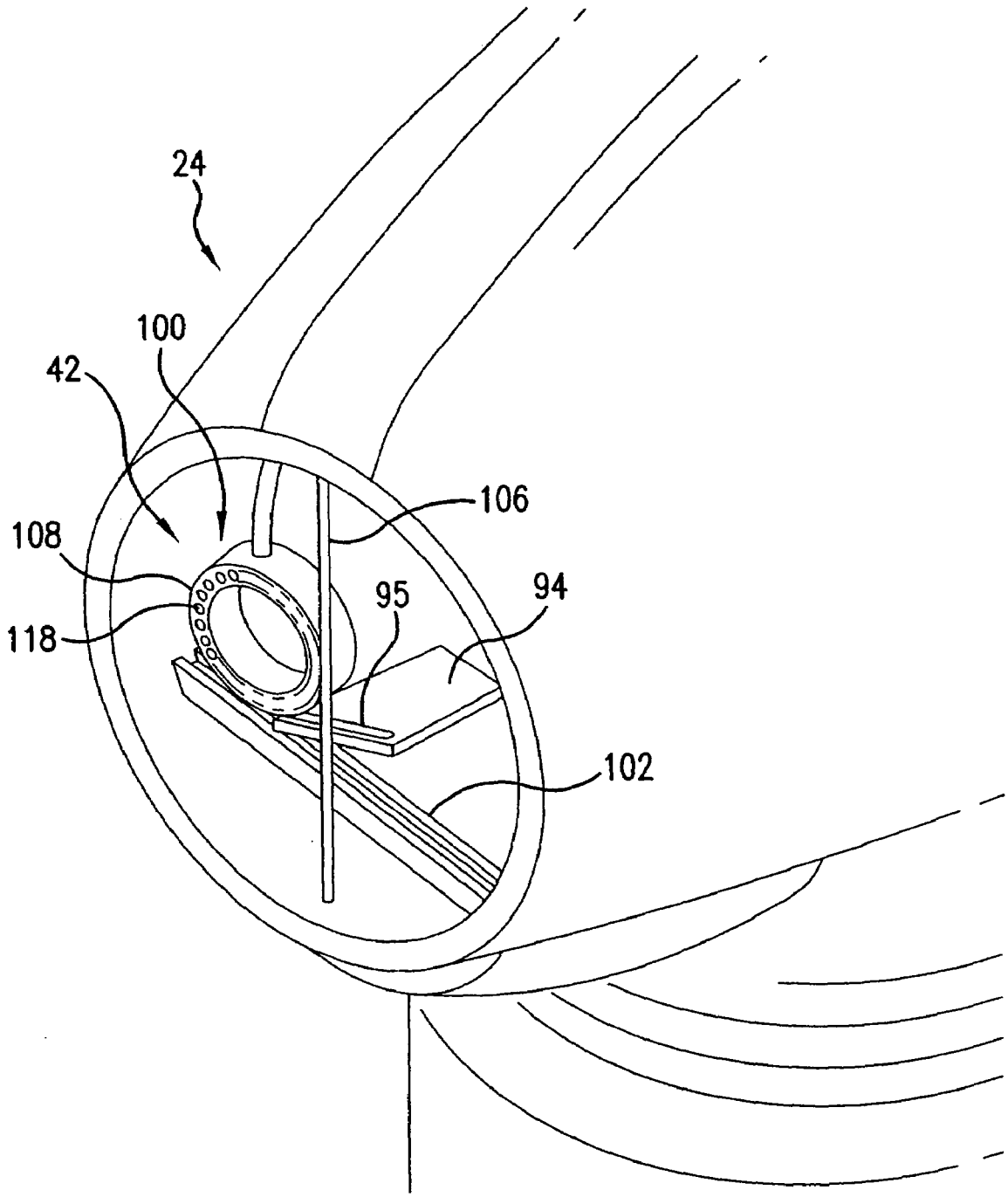
FIG. 5 is a front perspective view of the barrel section of the assembly of FIG. 1 showing the bubble ring in its normal rest position.

Referring also to FIGS. 2 and 5, a stationary vertical wiping bar 106 is fixedly attached to the interior of the barrel section 24 adjacent the opening 42 of the housing 22. The wiping bar 106 is positioned adjacent the bubble ring 100 so that the front face 108 of the bubble ring 100 wipes against the wiping bar 106 as the bubble ring 100 moves left and right along the rail 102. The bubble ring 100 has a through-hole 112 through which air can pass. The body of the bubble ring 100 has a hollow interior which communicates via an opening 114 with a tubing 116. The front face 108 of the bubble ring 100 has a plurality of spaced-apart fluid outlets 118 that communicate with the hollow interior of the bubble ring 100. In operation, as explained in greater detail below, bubble solution is pumped from the solution container 28 through the tubing 116 into the hollow interior of the bubble ring 100, where the bubble solution then leaks out through the outlets 118 to the front face 108 of the bubble ring 100.

As best shown in FIG. 2, a blower 120 (such as a fan) is secured inside the motor and blower housing 124 inside the barrel section 24, and is operatively connected to the motor 50 so that the blower 120 is actuated when the motor 50 is turned on. The blower 120 blows a stream of air that is directed by an air channel 122 towards the bubble ring 100.

Figure 4:
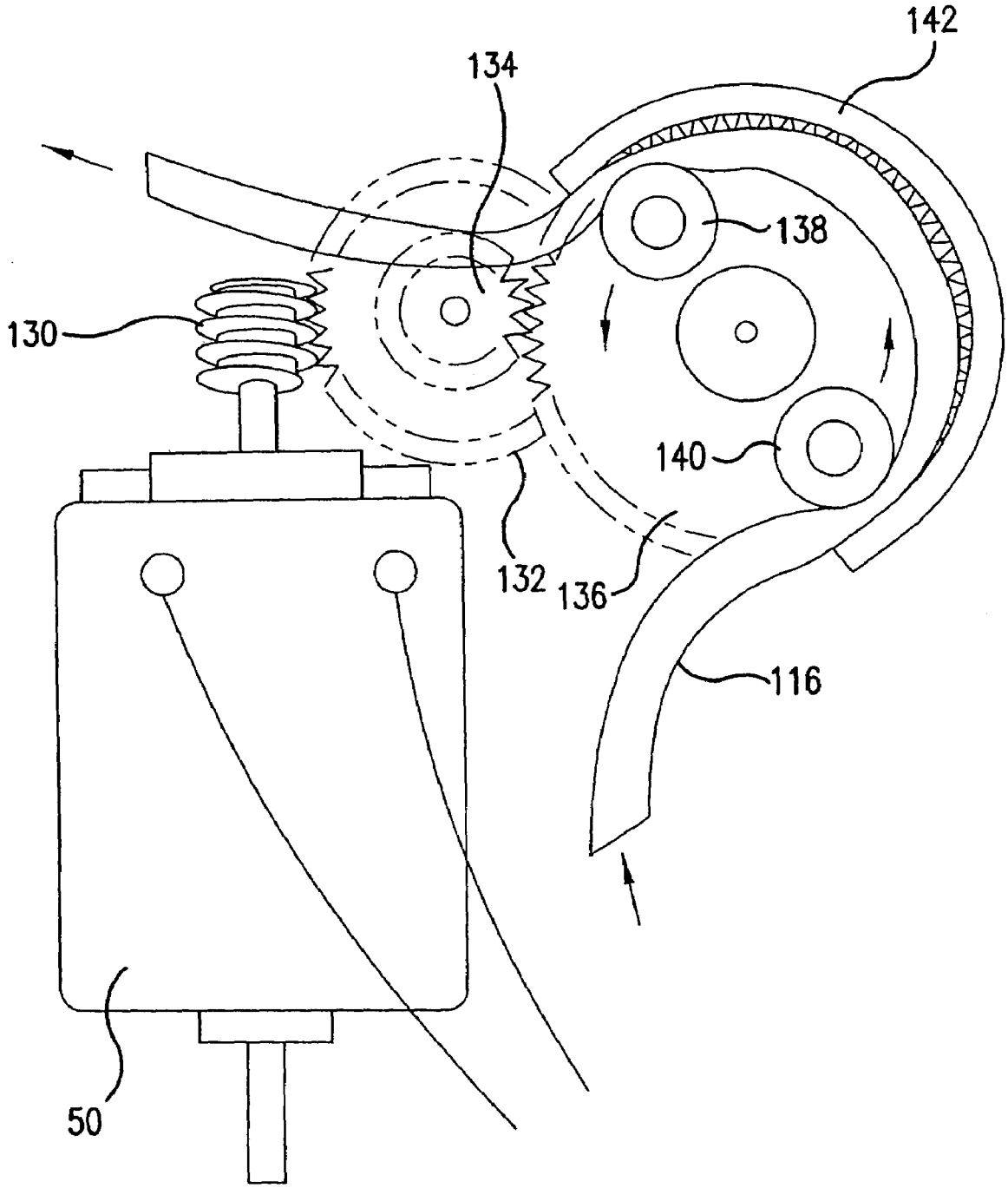
FIG. 4 is an enlarged view of the pump system of the assembly of FIG. 1.

Referring now to FIGS. 2 and 4, the assembly 20 includes a pump system that functions to pump the bubble solution from the solution container 28 to the bubble ring 100. The pump system includes the motor 50, the tubing 116 and a gear system that functions to draw bubble solution through the tubing 116. The motor 50 has a top gear 130 having teeth that are engaged with the teeth of a first gear 132. The first gear 132 carries a second gear 134 having teeth that are engaged with the teeth of a third gear 136. Two rollers 138 and 140 are carried on the side surface of the third gear 136. A guide wall 142 is provided adjacent the edge of the third gear 136. A space is defined between the guide wall 142 and the rollers 138 and 140, and the tubing 116 is positioned in a tight-fit in this space between the guide wall 142 and the rollers 138 and 140 in the manner shown in FIG. 4. The tubing 116 has a first end that is normally positioned inside the solution container 28, and extends through the housing 22 to a second end that terminates at the opening 114 of the bubble ring 100. Thus, when the motor 50 is turned on, the top gear 130 rotates, which causes the other gears 132, 134 and 136 in the gear system to rotate. As the third gear rotates 136, the rollers 138, 140 are turned in a counter-clockwise direction (as viewed from the orientation of FIG. 4). The rollers 138, 140 press on the tubing 116, so that the counter-clockwise rotation of the rollers 138, 140 will create a suction force that draws bubble solution from the solution container 28, through the tubing 116, and into the hollow interior of the bubble ring 100.

The assembly 20 operates in the following manner. To begin, the user attaches the solution container 28 to the connecting portion 32 by engaging the threads 36 and 38. See FIG. 2. Then, the user presses the trigger grip portion 70 in a rearward direction R, which causes two events to occur: (1) causing the curved end 62 of the contact 60 to couple the contact 64 which creates a closed electrical circuit, and (2) causing the bubble ring 100 to move along the rail 102.

First, the closed electrical circuit provides power to turn on and drive the motor 50. The motor 50 will cause the blower 120 to blow a stream of air through the channel 122 towards the bubble ring 100. In addition, the motor 50 will cause the pump system described above in connection with FIG. 4 to draw bubble solution from the solution container 28 to the hollow interior of the bubble ring 100, where the bubble solution will bleed out through the outlets 118 on to the front face 108 of the bubble ring 100.

Figure 6:
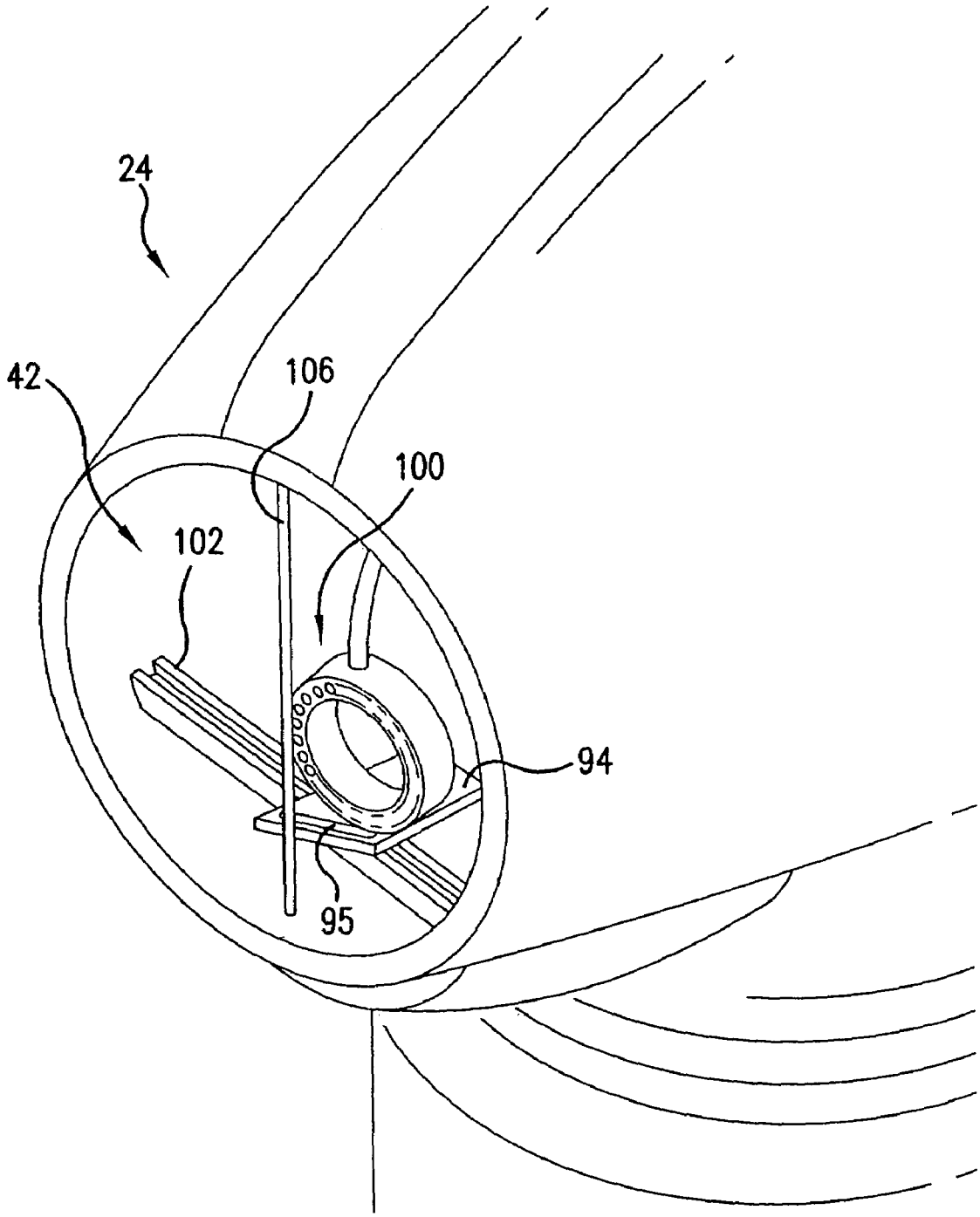
FIG. 6 is a front perspective view of the barrel section of FIG. 5 showing the bubble ring positioned after the bubble ring has moved passed the wiping bar.
Figure 7:
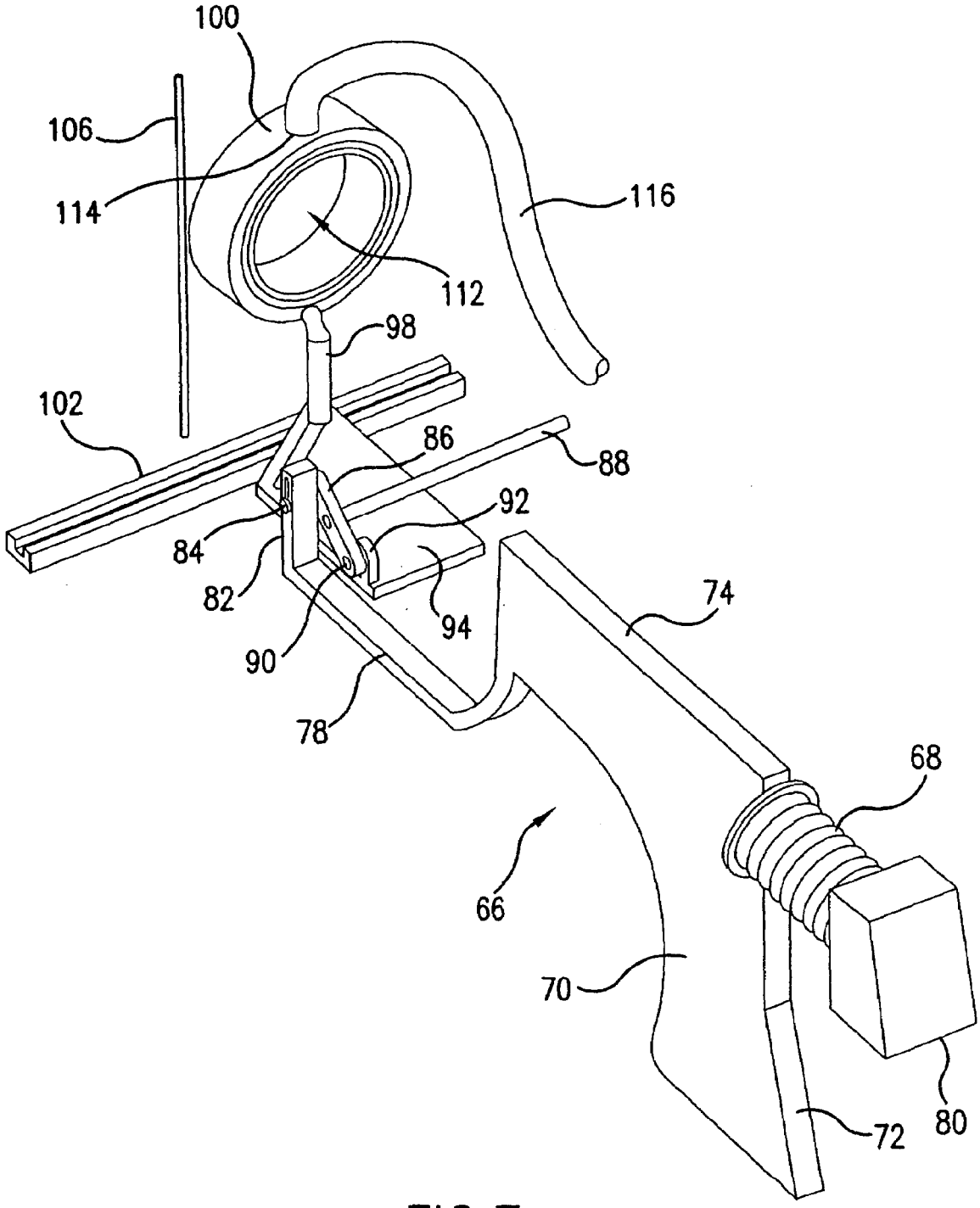
FIG. 7 is an enlarged isolated view of the link assembly of the bubble generating assembly of FIG. 2 with the bubble ring in its normal rest position.
Figure 8:
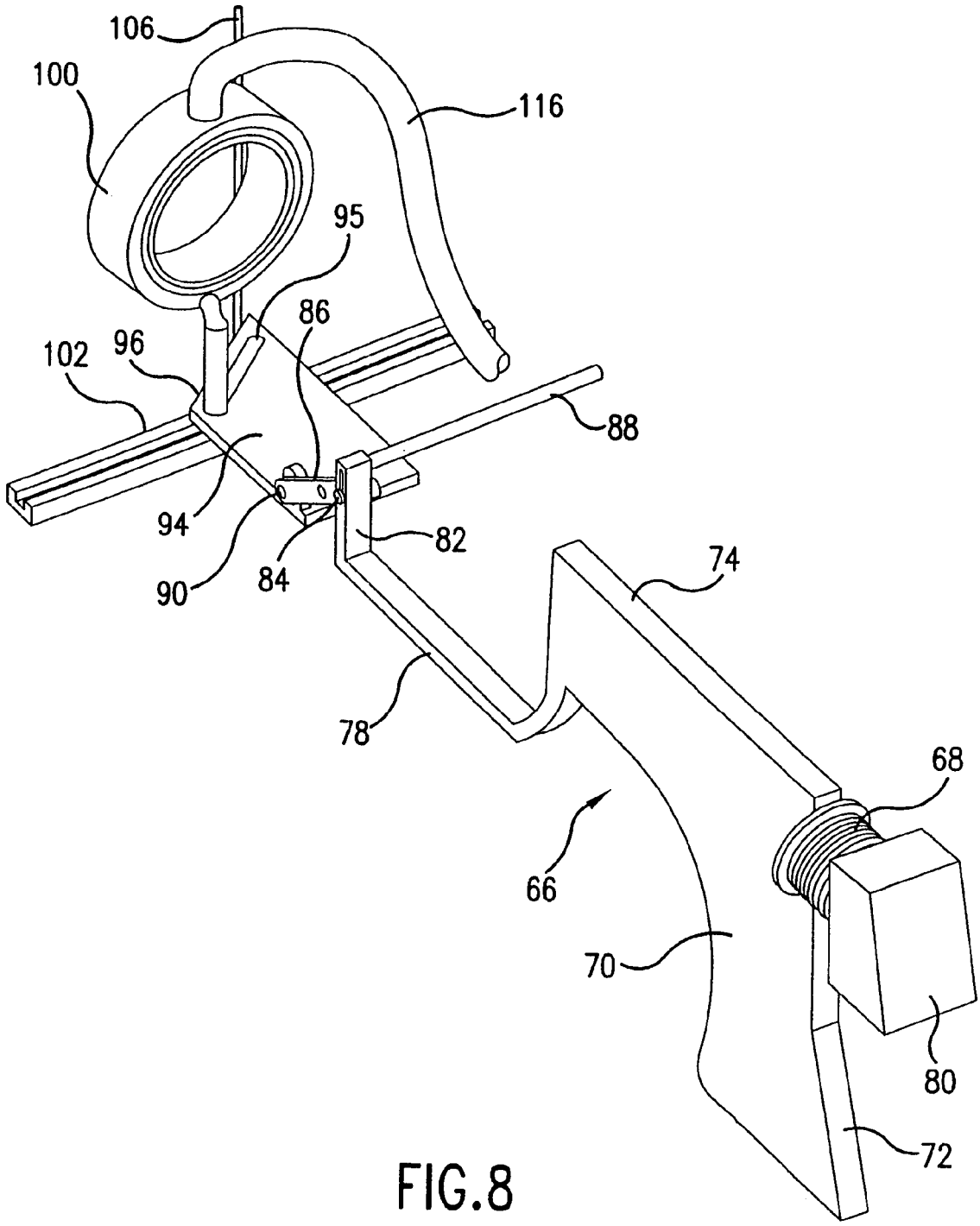
FIG. 8 is an enlarged isolated view of the link assembly of the bubble generating assembly of FIG. 2 after the bubble ring has moved passed the wiping bar.

Second, pressing the trigger grip portion 70 in the rearward direction R will pull the entire trigger block 66 rearwardly, thereby causing the axle bar 86 to pivot in a clockwise direction (as viewed from the orientation of FIG. 2) about the fixed pivot point defined by fixed bar 88. The clockwise pivot will cause the hooked end 84 of the axle bar 86 to move from front to rear in the direction R (as viewed from the orientation of FIG. 2), thereby pushing the bottom end of the axle bar 86 (i.e., where the coupling pin 90 is inserted) from rear to front in the direction F (as viewed from the orientation of FIG. 2). The rear to front pushing motion of the coupling pin 90 will push the slide plate 94 from rear to front in the direction, causing the support shaft 98 to slide within the slot 95, from one end to another end of the slot 95. As the support shaft 98 slides within the slot 95, the support shaft 98 (and its bubble ring 100) also moves along the rail 102. FIGS. 2, 5 and 7 illustrate the position of the support shaft 98 in the slot 95 and in the rail 102 when in the rest position (i.e., before the trigger block 66 is pulled rearwardly), and FIGS. 3, 6 and 8 illustrate the position of the support shaft 98 in the slot 95 and in the rail 102 after the trigger block 66 has been completely pressed. As the bubble ring 100 moves along the rail 102, the front face 108 of the bubble ring 100 is contacted by the stationary wiping bar 106, which wipes or spreads the bubble solution from the outlets 118 so as to create a film of bubble solution across the opening 112 of the bubble ring 100. The stream of air generated by the blower 120 will then travel through the film, thereby creating bubbles.

When the user releases his or her pressing grip on the trigger grip portion 70, the resilient element 68 will naturally bias the trigger block 66 in the forward direction F, leading to two events. First, the electrical connection between the contacts 60 and 64 is disengaged, causing the motor 50 to turn off so that the blower 120 stops blowing air and the pump system stops drawing bubble solution from the solution container 28. Second, the axle bar 86 is pivoted in a counter-clockwise direction (as viewed from the orientation of FIG. 2) to pull the slide plate 94 in the rearward direction R, thereby causing the support shaft 98 to move in the opposite direction inside the slot 95 and along the rail 102, so that the front face 108 of the bubble ring 100 passes the wiping bar 106 again to be wiped again by the wiping bar 106. In this regard, the fact the support shaft 98 is seated inside the slot 95 means that the slide plate 94 will automatically push the support shaft 98 along the rail 102 during this retraction motion. The user can intermittently press and release the trigger grip portion 70 to actuate the motor 50 and to cause the front face 108 of the bubble ring 100 to repeatedly contact the wiping bar 106, so as to create more bubbles.

Instead of arranging the bubble ring 100 to move in a left-right orientation across a vertical wiping bar, it is also possible to arrange the bubble ring 100 to move in a top-down orientation across a vertical wiping bar, as illustrated in FIGS. 9–12. Thus, the same numeral designations will be used for all the elements in the embodiment of FIGS. 9–12 which are identical to the elements in the embodiment of FIGS. 2–8, except that an "a" will be added to the designations in FIGS. 9–12.

Referring to FIGS. 9–12, the bubble ring 100*a*, the tubing 116*a*, the trigger block 66*a*, the resilient element 68*a*, the axle bar 86*a* and the support block 80*a* can be identical to the bubble ring 100, the tubing 116, the trigger block 66, the resilient element 68, the axle bar 86 and the support block 80, respectively, in FIGS. 2, 3, 7 and 8. In addition, the embodiment shown in FIGS. 9–12 can utilize the same elements as those illustrated in FIGS. 2–4, such as the motor 50, the blower 120, the pump system shown in FIG. 4, the electrical connections shown in FIG. 2, the solution container 28, and the connecting portion 32, so no further description of these elements will be furnished in connection with the embodiment in FIGS. 9–12.

In the embodiment of FIGS. 9–12, the center of the axle bar 86*a* also has an opening through which one end of a fixed bar 88*a* extends. The fixed bar 88*a* is fixed at a location and acts as a fixed pivot about which the axle bar 86*a* can pivot. The second end of the-axle bar 86*a* has another opening through which a coupling shaft 90*a* extends. The coupling shaft 90*a* couples the axle bar 86*a* to a portion of a vertical slide plate 94*a* for pivoting movement between the axle bar 86*a* and the slide plate 94*a*. Thus, the front leg 82*a*, the axle bar 86*a* and the slide plate 94*a* are coupled to experience pivoting movement with respect to each other when the trigger block 66*a* is pressed and released.

An angled slot 95*a* is provided adjacent an angled front edge 96*a* of the slide plate 94*a*, and is positioned to receive a horizontal support shaft 98*a* of the bubble ring 100*a*. The support shaft 98*a* is adapted to experience vertical (e.g., up and down) movement along a vertical rail 102*a* that is secured to the interior of the barrel section 24*a* adjacent the opening 42*a*. The angled nature of the slot 95*a* allows for reciprocating up-down movement of the slide plate 94*a* to cause the support shaft 98*a* to move up and down along the rail 102*a* as the support shaft 98*a* travels within the angled slot 95*a*.

A stationary horizontal wiping bar 106*a* is fixedly attached to the interior of the barrel section 24*a* adjacent the opening 42*a*. The wiping bar 106*a* is positioned adjacent the bubble ring 100*a* so that the front face 108*a* of the bubble ring 100*a* wipes against the wiping bar 106*a* as the bubble ring 100*a* moves up and down along the rail 102*a*.

The assembly 20 that uses the embodiment of FIGS. 9–12 operates in the following manner. To begin, the user attaches the solution container 28 to the connecting portion 32 by engaging the threads 36 and 38. See FIG. 2. Then, the user presses the trigger grip portion 70 in a rearward direction R, which causes two events to occur: (1) causing the curved end 62 of the contact 60 to couple the contact 64 which creates a closed electrical circuit, and (2) causing the bubble ring 100*a* to move along the rail 102*a*.

First, the closed electrical circuit provides power to turn on and drive the motor 50. The motor 50 will cause the blower 120 to blow a stream of air through the channel 122 towards the bubble ring 100*a*. In addition, the motor 50 will cause the pump system described above in connection with FIG. 4 to draw bubble solution from the solution container 28 to the hollow interior of the bubble ring 100*a*, where the bubble solution will bleed out through the outlets 118*a* on to the front face 108*a* of the bubble ring 100*a*.

Figure 9:
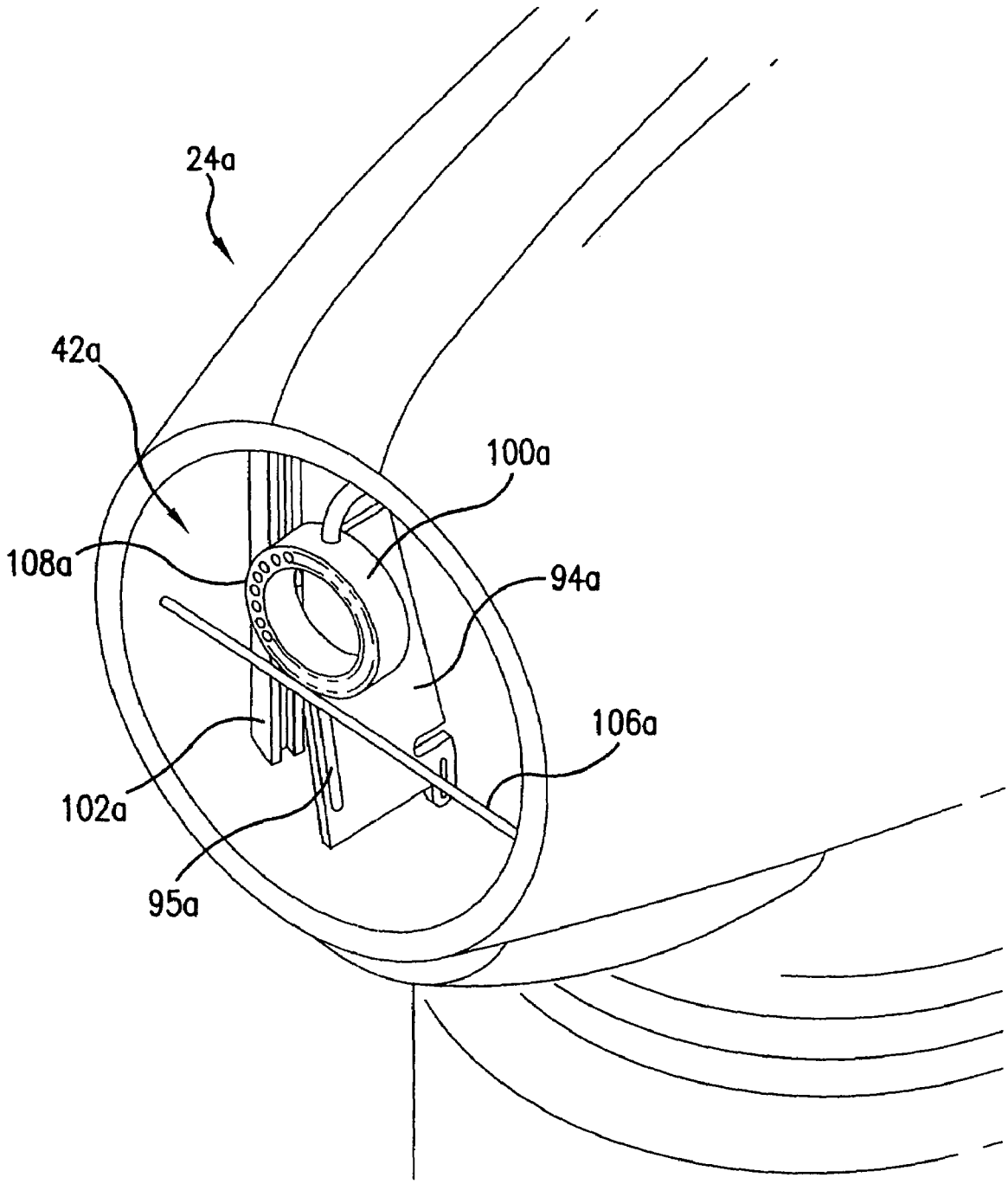
FIG. 9 is a front perspective view of the barrel section of the assembly of FIG. 1 illustrating another embodiment of the present invention, and showing the bubble ring in its normal rest position.
Figure 10:
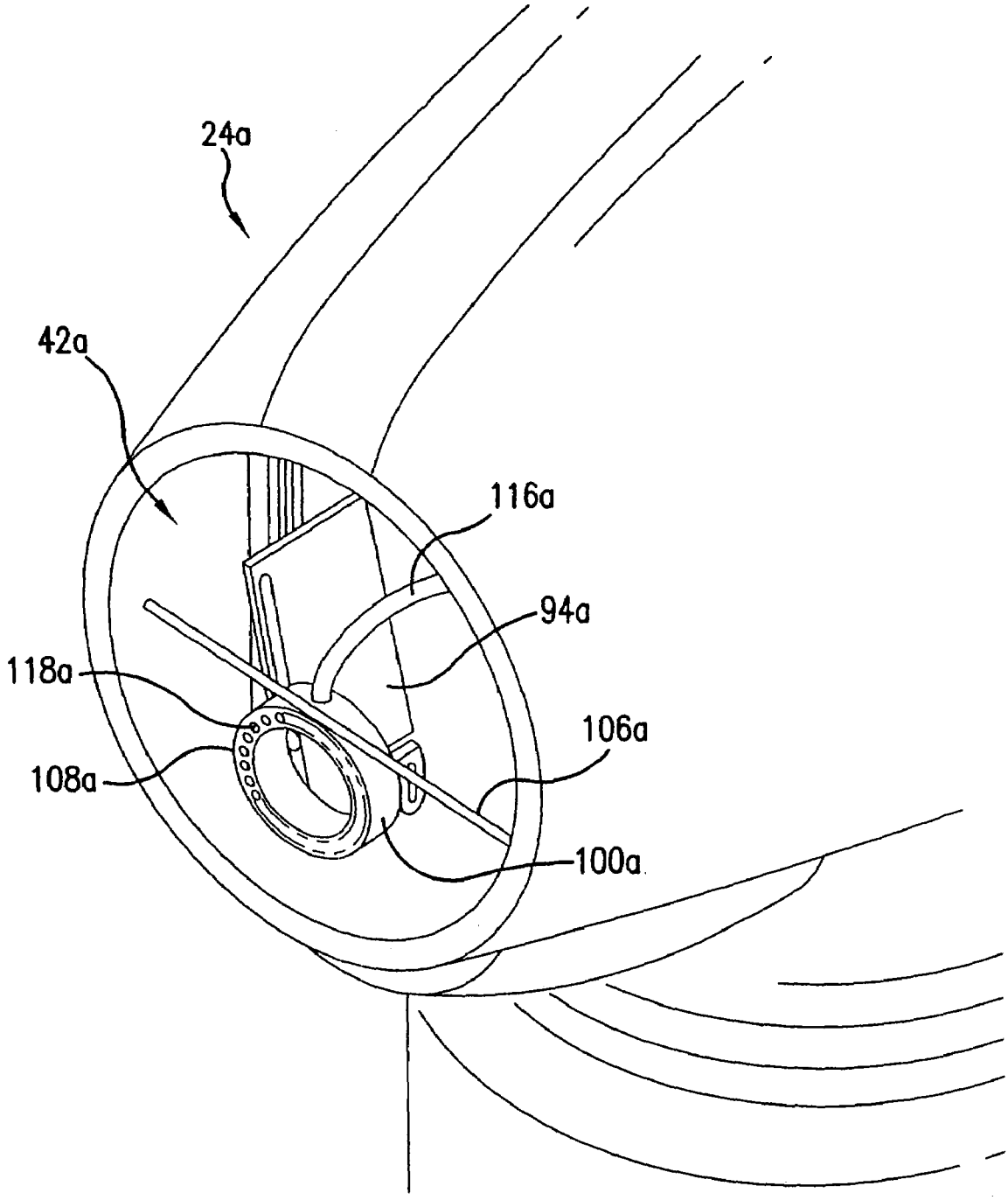
FIG. 10 is a front perspective view of the barrel section of FIG. 9 showing the bubble ring positioned after the bubble ring has moved passed the wiping bar.
Figure 11:
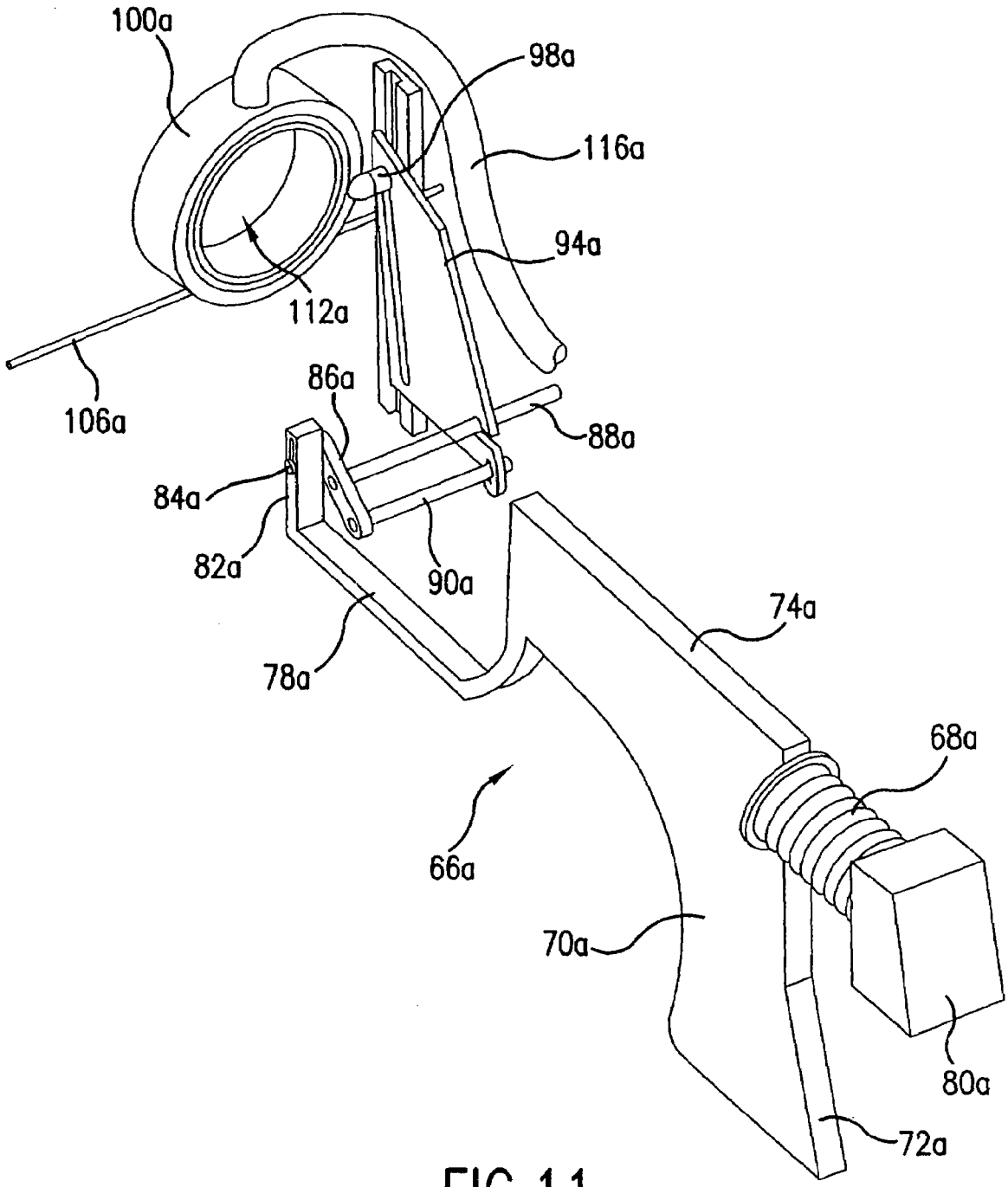
FIG. 11 is an enlarged isolated view of the link assembly of the bubble generating assembly of FIG. 9 with the bubble ring in its normal rest position.
Figure 12:
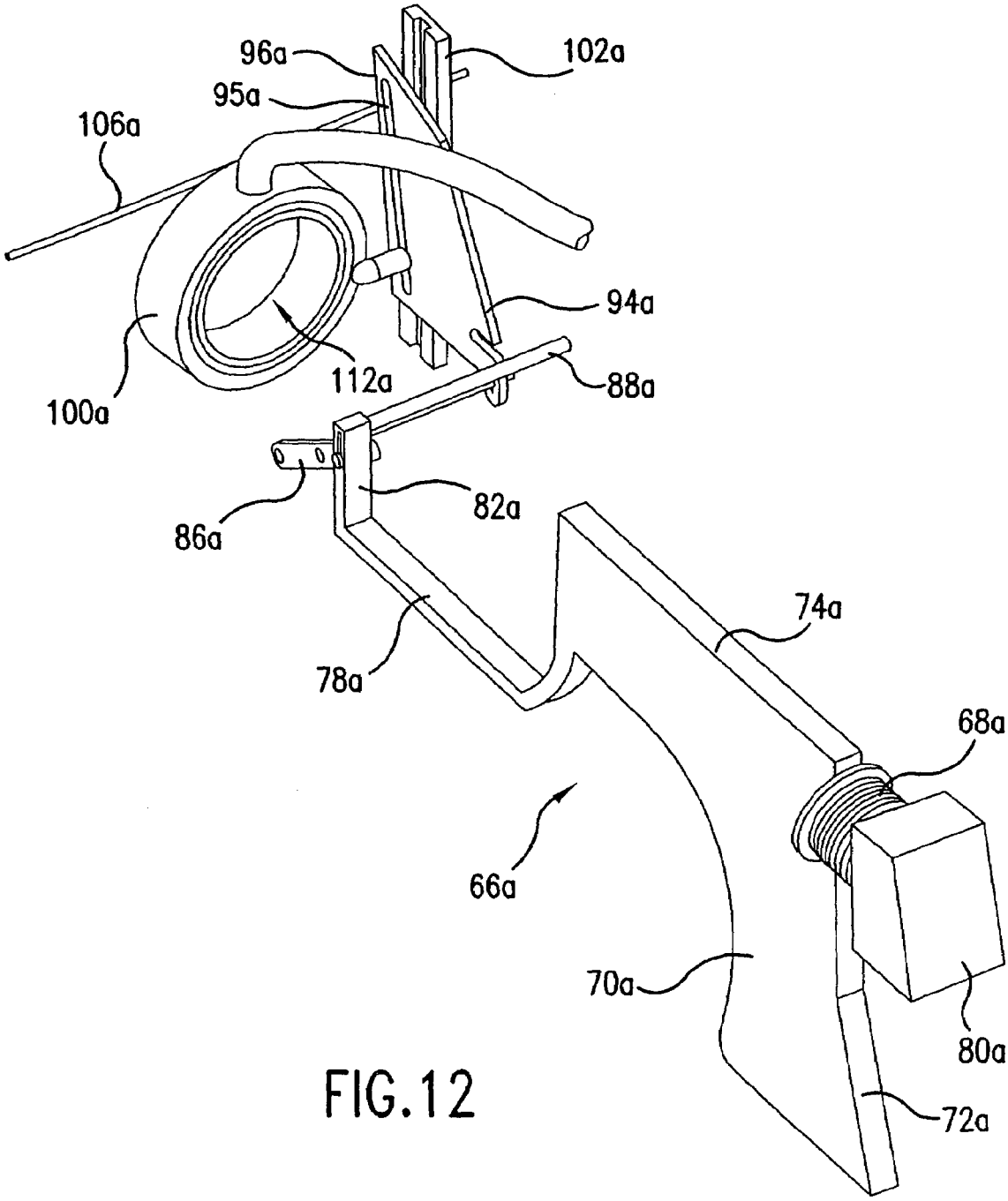
FIG. 12 is an enlarged isolated view of the link assembly of the bubble generating assembly of FIG. 9 after the bubble ring has moved passed the wiping bar.

Second, pressing the trigger grip portion 70*a* in the rearward direction R will pull the entire trigger block 66*a* rearwardly, thereby causing the axle bar 86*a* to pivot in a clockwise direction (as viewed from the orientation of FIG. 2) about the fixed pivot point defined by the fixed bar 88*a*. The clockwise pivot will cause the hooked end 84*a* of the axle bar 86*a* to move from front to rear in the direction R (as viewed from the orientation of FIG. 2), thereby pushing the bottom end of the axle bar 86*a* (i.e., where the coupling shaft 90*a* is inserted) from rear to front in the direction F (as viewed from the orientation of FIG. 2). The rear to front pushing motion of the coupling shaft 90*a* will push the slide plate 94*a* from rear to front in the direction F, causing the support shaft 98*a* to slide within the slot 95*a*, from one end to another end of the slot 95*a*. As the support shaft 98*a* slides within the slot 95*a*, the support shaft 98*a* (and its bubble ring 100*a*) also moves along-the rail 102*a*. FIGS. 9 and 11 illustrate the position of the support shaft 98*a* in the slot 95*a* and in the rail 102*a* when in the rest position (i.e., before the trigger block 66*a* is pulled rearwardly), and FIGS. 10 and 12 illustrate the position of the support shaft 98*a* in the slot 95*a* and in the rail 102*a* after the trigger block 66*a* has been completely pressed. As the bubble ring 100*a* moves along the rail 102*a*, the front face 108*a* of the bubble ring 100*a* is contacted by the stationary wiping bar 106*a*, which wipes or spreads the bubble solution from the outlets 118*a* so as to create a film of bubble solution across the opening 112*a* of the bubble ring 100*a*. The stream of air generated by blower 120 will then travel through the film, thereby creating bubbles.

When the user releases his or her pressing grip on the trigger grip portion 70*a*, the resilient element 68*a* will naturally bias the trigger block 66*a* in the direction F, leading to two events. First, the electrical connection between the contacts 60 and 64 is disengaged, causing the motor 50 to turn off so that the blower 120 stops blowing air and the pump system stops drawing bubble solution from the solution container 28. Second, the axle bar 86*a* is pivoted in a counter-clockwise direction (as viewed from the orientation of FIG. 2) to pull the slide plate 94*a* in the rearward direction R, thereby causing the support shaft 98*a* to move in the opposite direction inside the slot 95*a* and along the rail 102*a*, so that the front face 108*a* of the bubble ring 100*a* passes the wiping bar 106*a* again to be wiped again by the wiping bar 106*a*. In this regard, the fact the support shaft 98*a* is seated inside the slot 95*a* means that the slide plate 94*a* will automatically push the support shaft 98*a* along the rail 102*a* during this retraction motion. The user can intermittently press and release the trigger grip portion 70*a* to actuate the motor 50*a* and to cause the front face 108*a* of the bubble ring 100*a* to repeatedly contact the wiping bar 106*a*, so as to create more bubbles.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A bubble generating assembly comprising:
- a housing;
- a stationary wiping bar that is fixed to the housing; and
- a bubble generating device associated with the housing, and wherein the bubble generating device moves past the wiping bar and contacts the wiping bar.

2. The assembly of claim 1, wherein the housing defines an opening, with the wiping bar fixed to the housing adjacent the opening.

3. The assembly of claim 1, wherein the bubble generating device moves in a horizontal direction past the wiping bar.

4. The assembly of claim 1, wherein the bubble generating device moves in a vertical direction past the wiping bar.

5. The assembly of claim 3, wherein the wiping bar is a vertical wiping bar.

6. The assembly of claim 4, wherein the wiping bar is a horizontal wiping bar.

7. The assembly of claim 1, further including a rail along which the bubble generating device moves.

8. The assembly of claim 1, further including:
- a container coupled to the housing and retaining bubble solution, the container having an interior; and
- a tubing that couples the interior of the container with the bubble generating device.

9. The assembly of claim 8, wherein the bubble generating device has a generally circular body with a front face and a hollow interior, an opening communicating with the hollow interior and through which the tubing extends, and a plurality of outlets on the front face through which bubble solution can flow out.

10. The assembly of claim 8, further including:
- a trigger mechanism
- a motor operatively coupled to the trigger mechanism;
- an air generator coupled to the motor and directing air towards the bubble generating device; and
- a gear system coupled to the motor and applying pressure to the tubing to cause bubble solution to be delivered from the container to the bubble generating device.

11. The assembly of claim 10, wherein actuation of the trigger mechanism simultaneously causes (i) the air generator to direct air towards the bubble generating device, (ii) the gear system to deliver bubble solution from the container to the bubble generating device, and (iii) the bubble generating device to move.

12. The assembly of claim 10, further including a link system which includes:
- a trigger block that includes the trigger mechanism;
- an axle bar pivotably coupled to the trigger block;

a slide plate pivotably coupled to the axle bar, and having an angled slot that retains the bubble generating device; and wherein longitudinal movement of the trigger block pivots the axle bar to cause the slide plate to move, which in turn causes the bubble generating device to move within the angled slot.

13. The assembly of claim 12, wherein the slide plate moves forward when the trigger mechanism is pressed, and wherein the slide plate moves rearwardly when the trigger mechanism is released.

14. The assembly of claim 8, wherein the container is removably coupled to the housing.

15. The assembly of claim 1, wherein the bubble generating device is positioned inside the housing.

16. A method for generating bubbles, comprising:

a. providing a bubble generating assembly that has a housing, a stationary wiping bar that is fixed to the housing, and a bubble generating device;

b. delivering bubble solution to the bubble generating device; and c. moving the bubble generating device past the wiping bar and contacting the wiping bar.

17. The method of claim 16, further including:

directing air at the bubble generating device.

18. The method of claim 16, wherein step (c) further includes moving the bubble generating device horizontally.

19. The method of claim 16, wherein step (c) further includes moving the bubble generating device vertically.

* * * * *